US007837358B2

(12) United States Patent
Liao

(10) Patent No.: US 7,837,358 B2
(45) Date of Patent: Nov. 23, 2010

(54) LIGHT-EMITTING DIODE MODULE WITH HEAT DISSIPATING STRUCTURE

(76) Inventor: Yun-Chang Liao, No. 103, Wunsyue 1st St., Renwu Township, Kaohsiung (TW)

( * ) Notice: Subject to any disclaimer, the term of this patent is extended or adjusted under 35 U.S.C. 154(b) by 239 days.

(21) Appl. No.: 12/190,637

(22) Filed: Aug. 13, 2008

(65) Prior Publication Data

US 2009/0284973 A1 Nov. 19, 2009

(30) Foreign Application Priority Data

May 16, 2008 (TW) ..... 97118242 A

(51) Int. Cl.
*F21V 29/00* (2006.01)

(52) U.S. Cl. ..... 362/294; 362/249.02; 362/264

(58) Field of Classification Search ..... 362/218, 362/240, 247, 249.01, 249.02, 249.06, 249.14, 362/255, 264, 294, 345, 373, 507, 545, 547, 362/800; 257/98–100, 722; 361/707
See application file for complete search history.

(56) References Cited

U.S. PATENT DOCUMENTS

| | | | | |
|---|---|---|---|---|
| 4,204,246 | A | 5/1980 | Arii et al. | |
| 7,048,412 | B2 * | 5/2006 | Martin et al. | 362/247 |
| 7,210,832 | B2 * | 5/2007 | Huang | 362/547 |
| 7,314,291 | B2 * | 1/2008 | Tain et al. | 362/294 |
| 7,331,691 | B2 * | 2/2008 | Livesay et al. | 362/294 |
| 7,413,326 | B2 * | 8/2008 | Tain et al. | 362/294 |
| 7,434,964 | B1 * | 10/2008 | Zheng et al. | 362/294 |
| 7,543,960 | B2 * | 6/2009 | Chang et al. | 362/294 |
| 7,568,817 | B2 * | 8/2009 | Lee et al. | 362/294 |
| 7,572,033 | B2 * | 8/2009 | Sun et al. | 362/294 |
| 7,581,856 | B2 * | 9/2009 | Kang et al. | 362/373 |
| 7,635,205 | B2 * | 12/2009 | Yu et al. | 362/294 |
| 2004/0213016 | A1 | 10/2004 | Rice | 362/547 |
| 2005/0024875 | A1 | 2/2005 | Zhang | 362/264 |
| 2008/0130299 | A1 * | 6/2008 | Dorogi | 362/373 |

* cited by examiner

*Primary Examiner*—Hargobind S Sawhney
(74) *Attorney, Agent, or Firm*—Alan Kamrath; Kamrath & Associates PA

(57) ABSTRACT

A light-emitting diode module with a heat dissipating structure includes a metal substrate and a plurality of light-emitting diode dies mounted on a face of the metal substrate. A jacket has a coupling surface engaged with the other face of the metal substrate. A heat conduction pipe includes a portion received in a longitudinal hole of the jacket. The coupling surface of the jacket has an opening in communication with the longitudinal hole. A portion of an outer periphery of the portion of the heat conduction pipe is in direct, thermal contact with the other face of the metal substrate through the opening of the jacket to absorb heat generated by the light-emitting diode dies. A finned heat sink is mounted on another portion of the heat conduction pipe outside the jacket to dissipate heat transferred to the heat conduction pipe into the environment.

6 Claims, 10 Drawing Sheets

LIGHT-EMITTING DIODE MODULE WITH HEAT DISSIPATING STRUCTURE

BACKGROUND OF THE INVENTION

The present invention relates to a light-emitting diode module, and more particularly, to a light-emitting diode module with a heat dissipating structure.

Light-emitting diode modules including packaged light-emitting diodes (LEDs) are widely used as light sources in a variety of signs and image displays. LED dies generate heat during operation, which heat must be removed to keep high illumination efficiency. To this end, heat dissipating devices are provided to dissipate heat generated inside the light sources to the surrounding environment. Conventional heat dissipating devices for LED light sources generally include a heat sink connected to a circuit board or a substrate on which LEDs are disposed. However, directly assembling of the heat sink to the circuit board or substrate is not easy and could damage the LEDs during assembly.

U.S. Pat. No. 4,204,246 disclosed a cooling assembly including a heat generating electric part, a heat conductive block mounting the heat generating electric part, and a heat pipe attached to the heat conductive block for radiating the heat from the heat generating electric part to the air through the heat conductive block. Plural cooling fins are fixed on a condensing portion of the heat pipe to obtain a higher radiation effect. However, the assembly of the heat generating electric part and the heat conductive block is complicated. Further, the heat pipe is not in direct, thermal contact with the heat generating electric part, resulting in unsatisfactory heat dissipation effect.

A need exists for a light-emitting diode module with a heat dissipating structure that allow easy assembly while having improved heat dissipation efficiency.

BRIEF SUMMARY OF THE INVENTION

The present invention solves this need and other problems in the field of heat dissipation for LEDs by providing, in a preferred form, a light-emitting diode module including a metal substrate having a first face and a second face opposite to the first face. A plurality of light-emitting diode dies are mounted to the first face of the metal substrate and in direct, thermal contact with the metal substrate. A jacket includes a coupling surface engaged with the second face of the metal substrate. The jacket further includes a longitudinal hole having a longitudinal axis. The coupling surface of the jacket has an opening extending in a direction parallel to the longitudinal axis and in communication with the longitudinal hole. A heat conduction pipe includes a first portion received in the longitudinal hole of the jacket and a second portion outside the jacket. The first portion of the heat conduction pipe has an outer periphery. A portion of the outer periphery of the first portion of the heat conduction pipe is in direct, thermal contact with the second face of the metal substrate through the opening of the jacket to absorb heat generated by the plurality of light-emitting diode dies. A finned heat sink is mounted on the second portion of the heat conduction pipe and includes a plurality of fins to dissipate heat transferred to the heat conduction pipe into an environment outside the finned heat sink.

In a preferred form, the jacket is a thermally conductive metal block. The longitudinal hole is circular in cross section, and the opening extends in a plane tangent to the longitudinal hole.

In another preferred form, the jacket is a thermally conductive metal tube having C-shaped cross sections such that the first portion of the heat conduction pipe can be clamped in the longitudinal hole. The metal tube has two parallel, spaced, longitudinal edges each extending in a direction parallel to the longitudinal axis, and the opening is defined between the two longitudinal edges. Two longitudinal bends project outwardly away from each other and from the two longitudinal edges and extend in a plane parallel to the opening. Each longitudinal bend includes a surface facing the second face of the metal substrate and forming the coupling surface.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
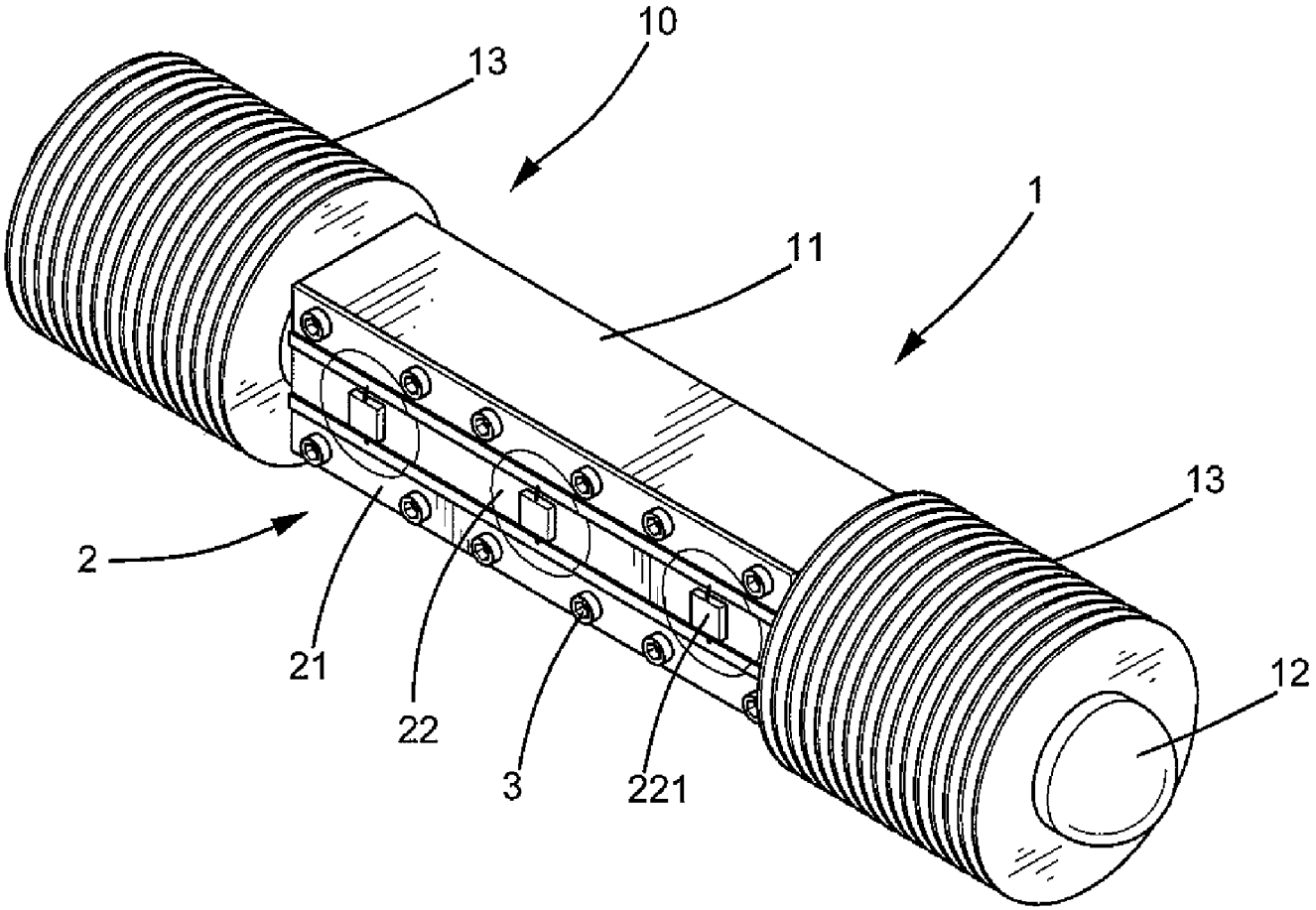
FIG. 1 shows a perspective view of a light-emitting diode module of a first embodiment according to the preferred teachings of the present invention.
Figure 2:
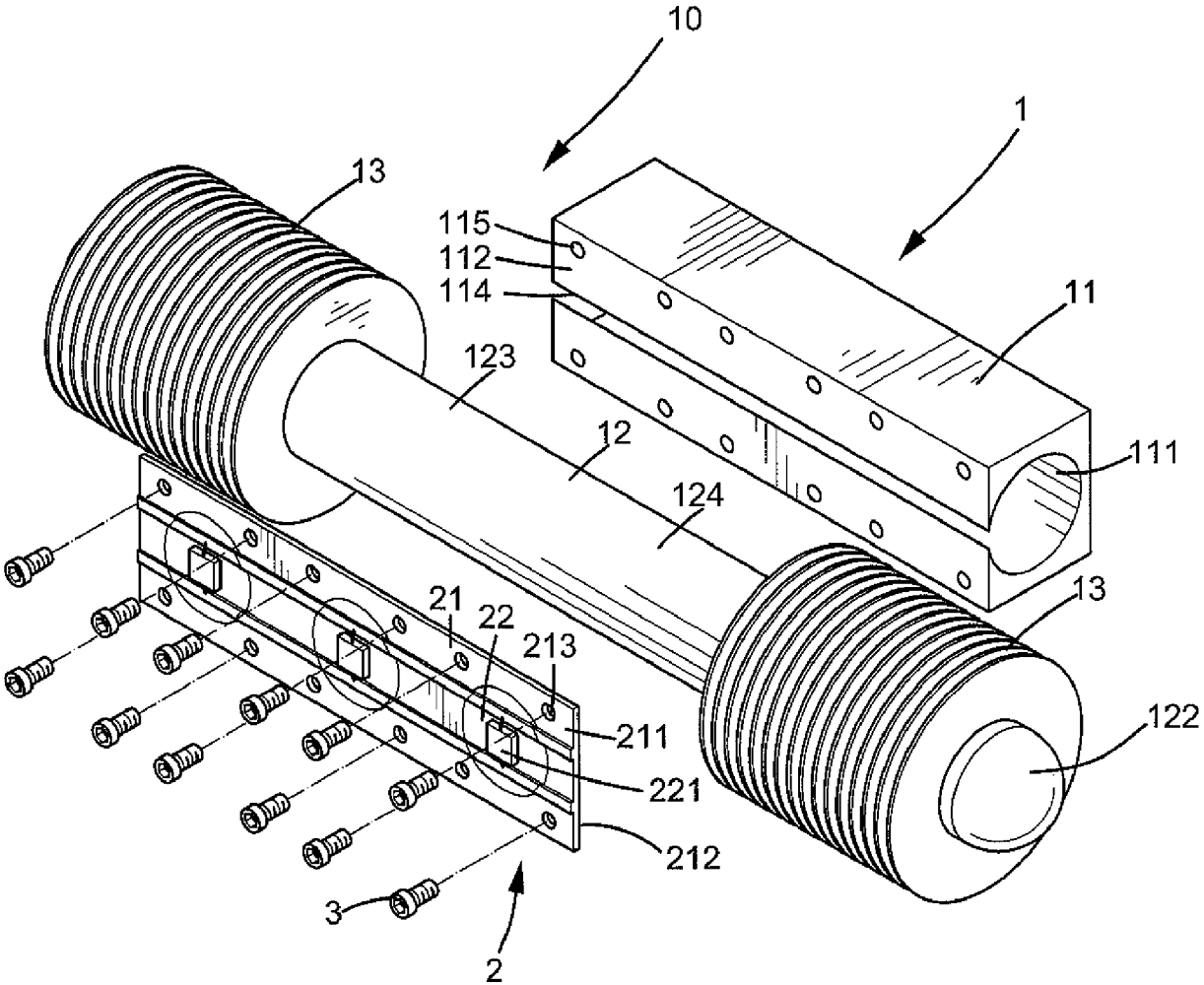
FIG. 2 shows an exploded perspective view of the light-emitting diode module of FIG. 1.
Figure 3:
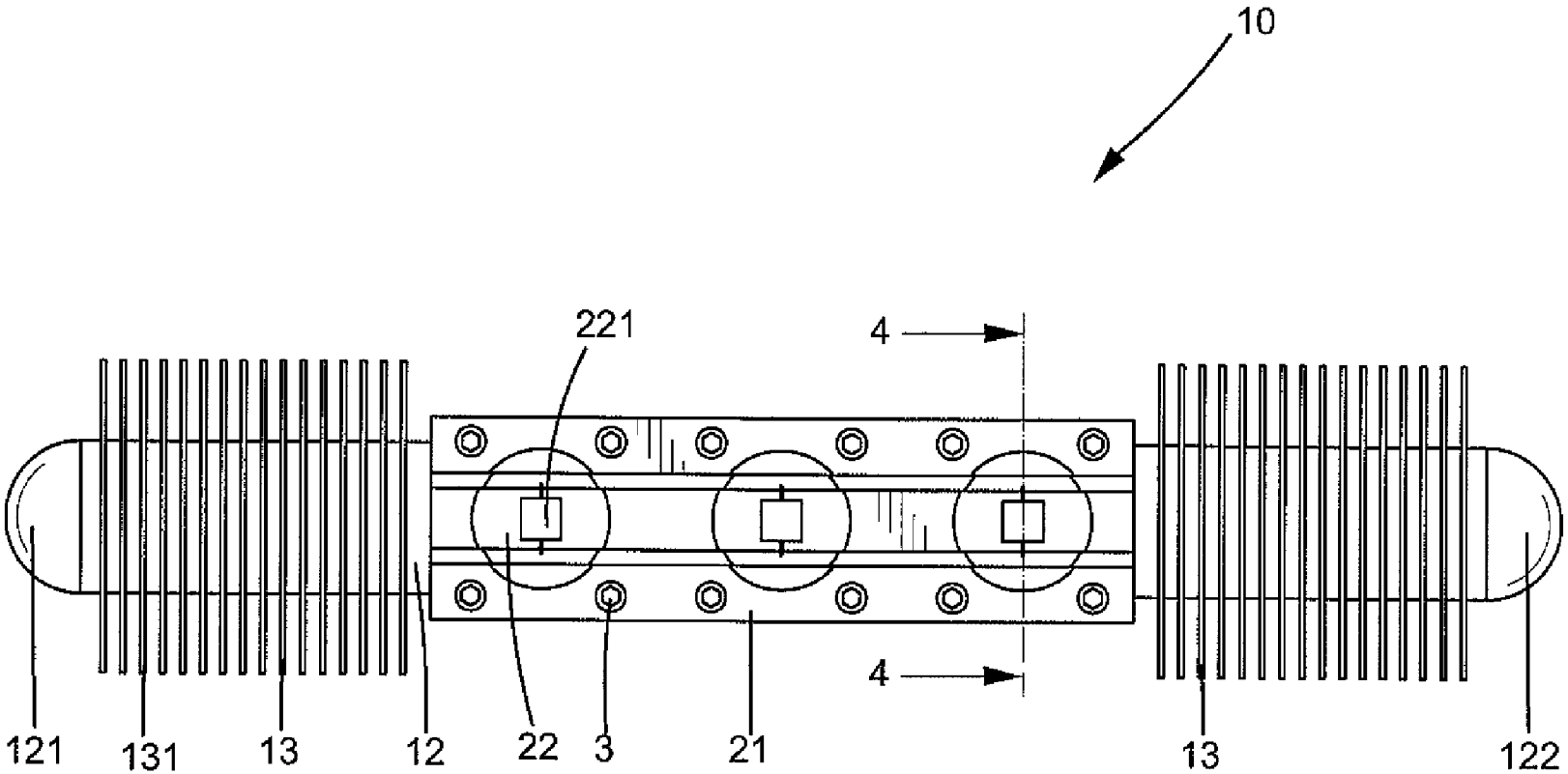
FIG. 3 shows a side view of the light-emitting diode module of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "portion" "longitudinal", "annular", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A light-emitting diode module with a heat dissipating structure of an embodiment according to the preferred teachings of the present invention is shown in FIGS. 1-4 of the drawings and generally designated 10. According to the preferred form shown, light-emitting diode module 10 includes a light-emitting diode (LED) light source assembly 2 including a metal substrate 21 having a first face 211 and a second face 212 opposite to first face 211, and a plurality of light-emitting diodes 22 as a light source. Each light-emitting diode 22 includes at least one LED die 221 mounted to first face 211 of metal substrate 21 and in direct, thermal contact with metal substrate 21. According to the most preferred form shown, metal substrate 21 has a thickness ranging from 0.5 to 1 mm and a plurality of through-holes 213 extending from first face 211 through second face 212.

Figure 4:
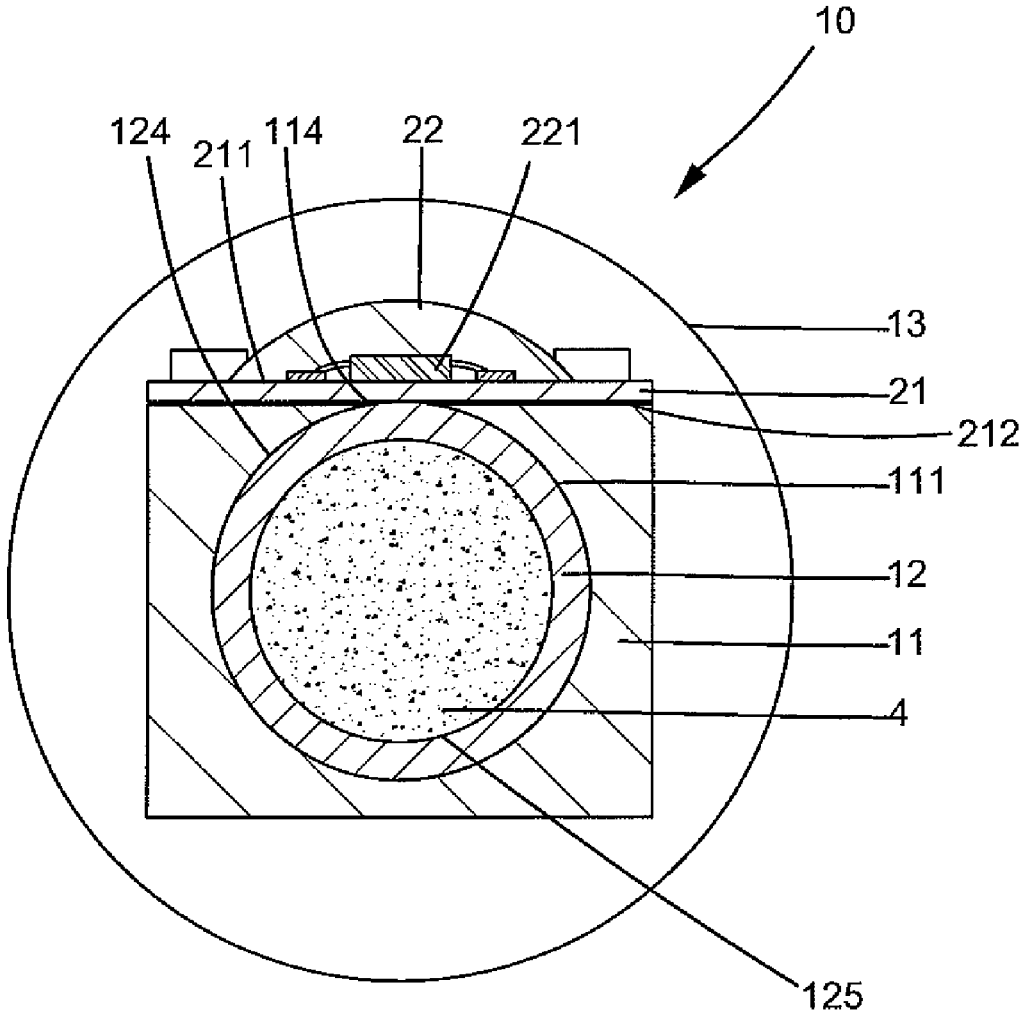
FIG. 4 is a cross sectional view taken along plane 4-4 in FIG. 3.
Figure 5:
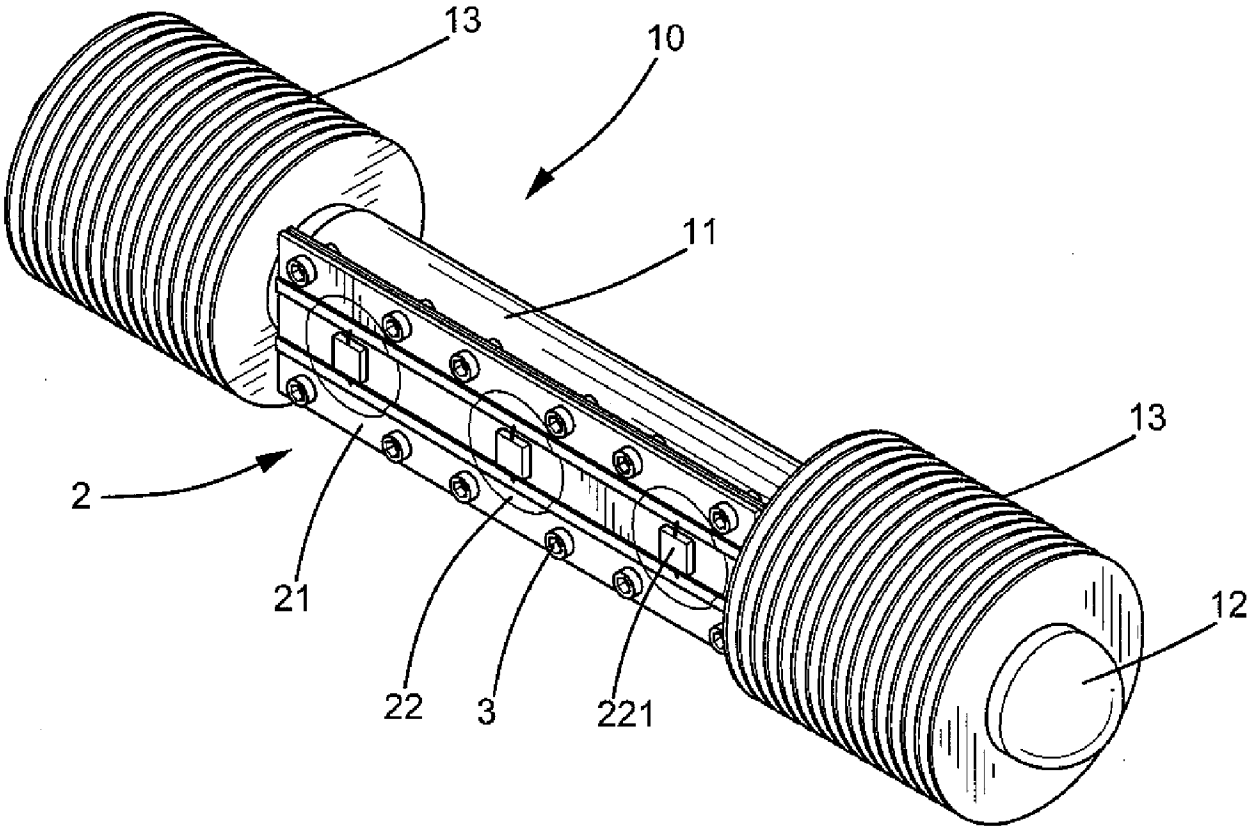
FIG. 5 shows a perspective view of a light-emitting diode module of a second embodiment according to the preferred teachings of the present invention.
Figure 6:
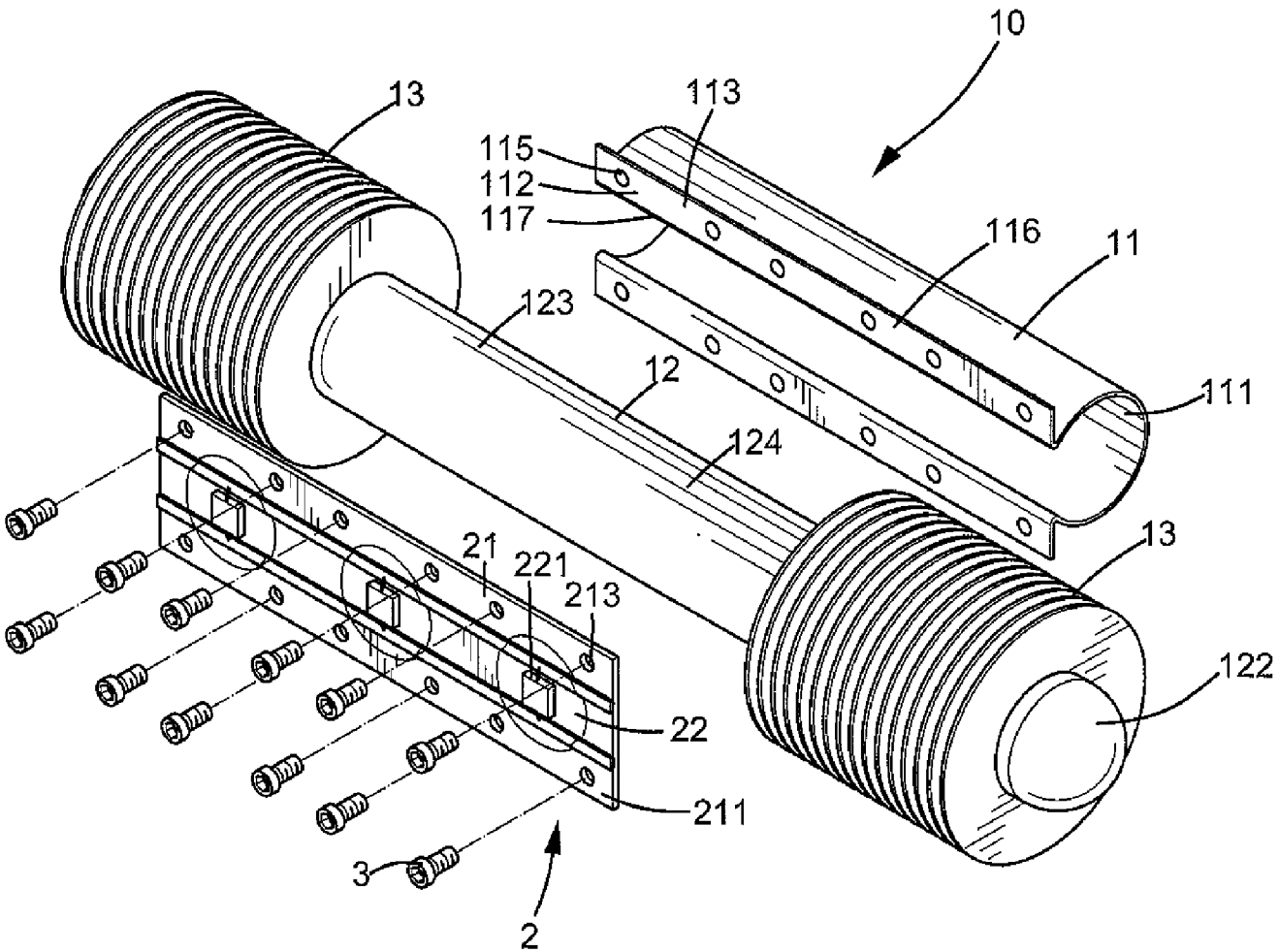
FIG. 6 shows an exploded perspective view of the light-emitting diode module of FIG. 5
Figure 7:
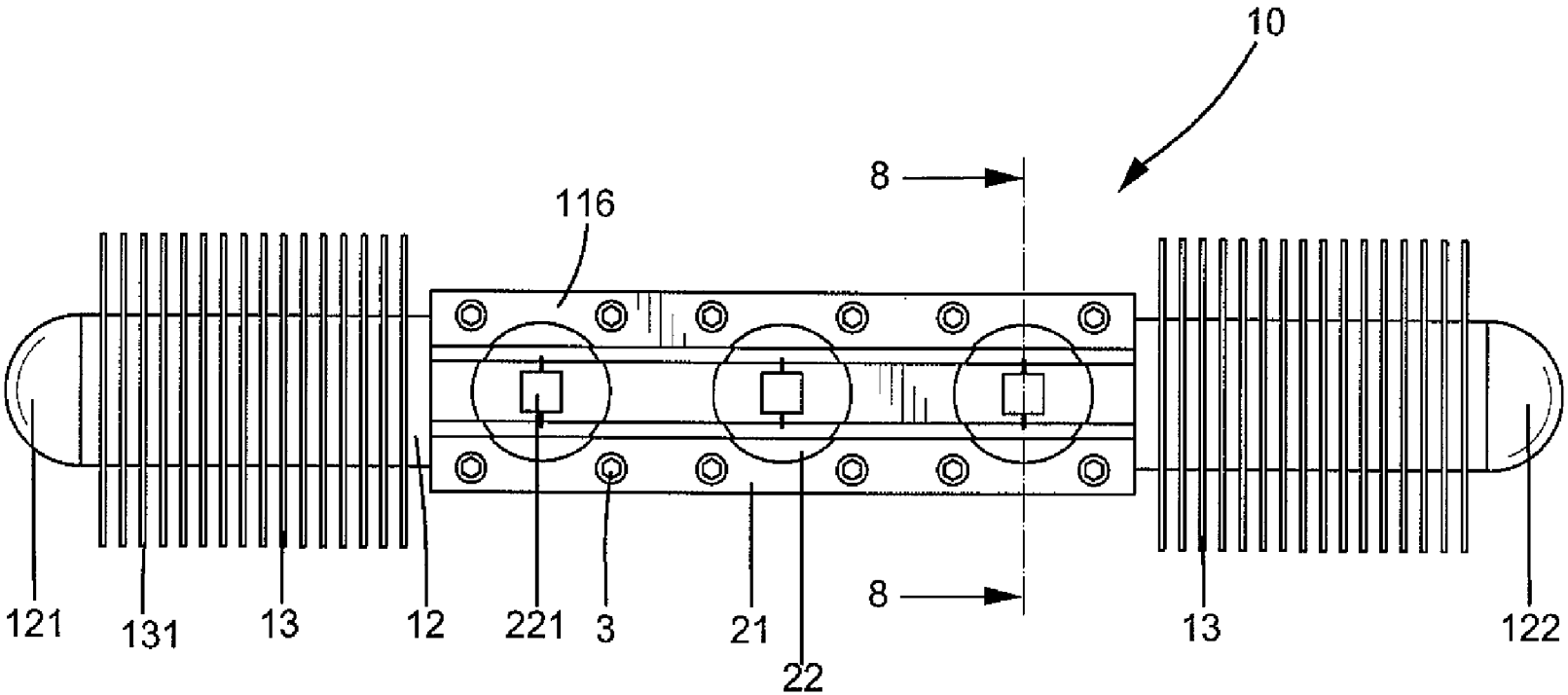
FIG. 7 shows a side view of the light-emitting diode module of FIG. 5.
Figure 8:
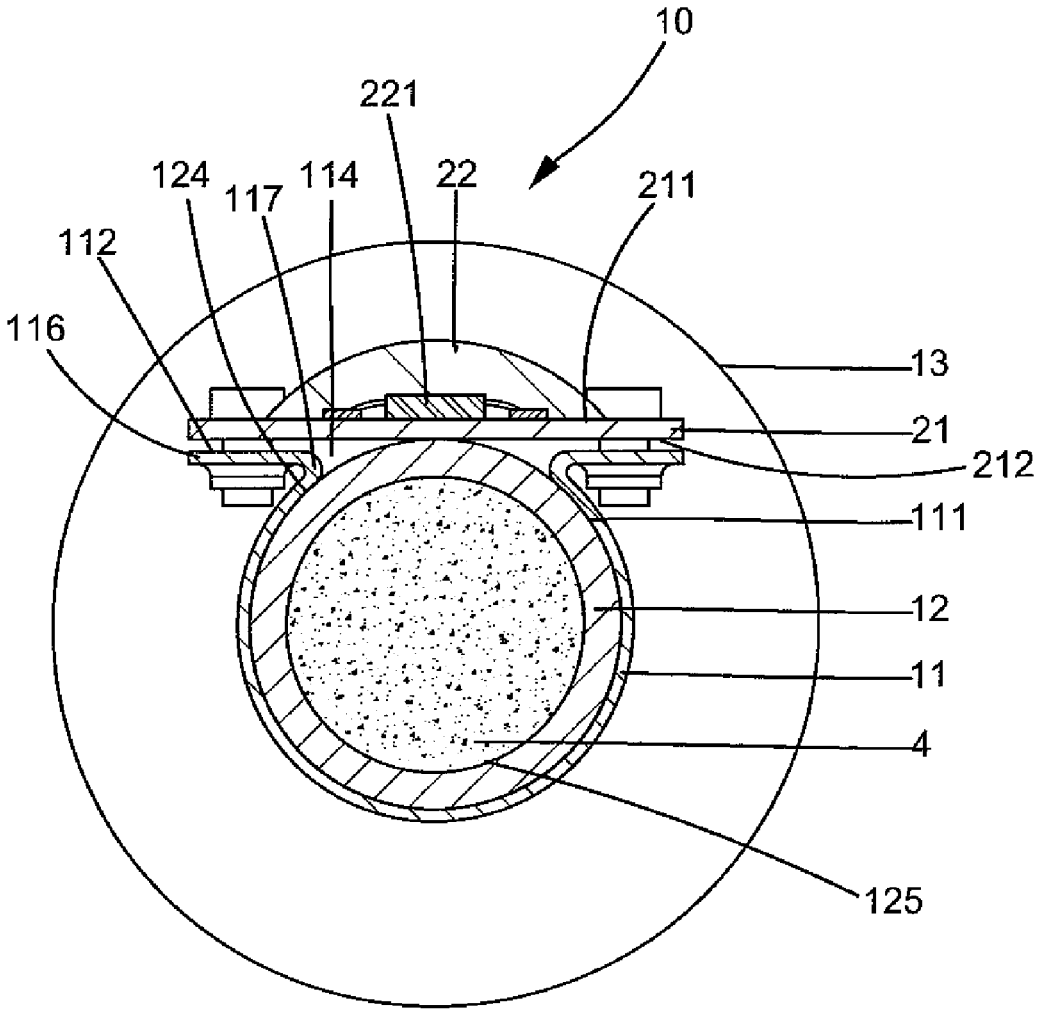
FIG. 8 is a cross sectional view taken along plane 8-8 in FIG. 7.

According to the preferred form shown, light-emitting diode module 10 further includes a heat dissipating module 1 including a jacket 11, a heat conduction pipe 12, and two finned heat sinks 13. Jacket 11 is made of a thermally conductive metal, such as an aluminum or copper block. Jacket 11 includes a longitudinal hole 111 having a longitudinal axis. Jacket 11 further includes a coupling surface 112 engaged with second face 212 of metal substrate 21. According to the most preferred form shown, coupling surface 112 includes a plurality of engaging holes 115, and a plurality of fasteners 3 are respectively extended through through-holes 213 of metal substrate 21 into engaging holes 115 of jacket 11 to engage metal substrate 21 with jacket 11. Coupling surface 112 of jacket 11 has an opening 114 extending in a direction parallel to the longitudinal axis of longitudinal hole 111 and in communication with longitudinal hole 111. Longitudinal hole 111 is circular in cross section, and opening 114 extends in a plane tangent to longitudinal hole 111. Heat conduction pipe 12 includes a first portion 123 received in longitudinal hole 111 of jacket 11, a second portion 121 outside jacket 11, and a third portion 122 outside jacket 11. First portion 123 of heat conduction pipe 12 is intermediate between second portion 121 and third portion 122. First portion 123 has an outer periphery 124. A portion of outer periphery 124 of first portion 123 of heat conduction pipe 12 is in direct, thermal contact with second face 212 of metal substrate 21 through opening 114 of jacket 11 to absorb heat generated by light-emitting diode dies 221 (FIG. 4). Heat conduction pipe 12 includes annular cross sections and defines a chamber 125 in which heat transfer medium 4 such as superconducting material is received. Finned heat sinks 13 are respectively mounted on second and third portions 122 and 123 of heat conduction pipe 12. Each finned heat sink 13 includes a plurality of fins 131 to dissipate heat transferred to heat conduction pipe 12 into the environment outside finned heat sinks 13.

Heat dissipating module 1 of the present invention is engaged with metal substrate 21 of LED light source assembly 2 via coupling surface 112 of jacket 11 to allow easy assembly and to prevent damage to LEDs 22. Further, a more effective thermal conduction path is provided by direct, thermal contact between heat conduction pipe 12 and metal substrate 21 of LED light source assembly 2. Increasing the heat dissipating efficiency is, thus, provided to LEDs 22.

FIGS. 5 through 8 show an alternate embodiment of jacket 11 of light-emitting diode module 10 according to the present invention. Jacket 11 in the preferred form shown is a thermally conductive metal tube including C-shaped cross sections such that first portion 123 of heat conduction pipe 12 can be clamped in longitudinal hole 111 of jacket 11 to facilitate engagement between heat conduction pipe 12 and jacket 11. According to the preferred form shown, jacket 11 has two parallel, spaced, longitudinal edges 117 each extending in a direction parallel to the longitudinal axis of longitudinal hole 111, and an opening 114 is defined between longitudinal edges 117. Two longitudinal bends 116 project outwardly away from each other and from longitudinal edges 117 and extend in a plane parallel to opening 114. Each longitudinal bend 116 includes a surface facing second face 212 of metal substrate 21. The surfaces of longitudinal bends 116 form coupling surface 112. Each longitudinal bend 116 further includes a plurality of engaging holes 115, and a plurality of fasteners 3 are respectively extended through through-holes 213 of metal substrate 21 into engaging holes 115 of metal tube 11 to securely engage metal substrate 21 with jacket 11.

Figure 9:
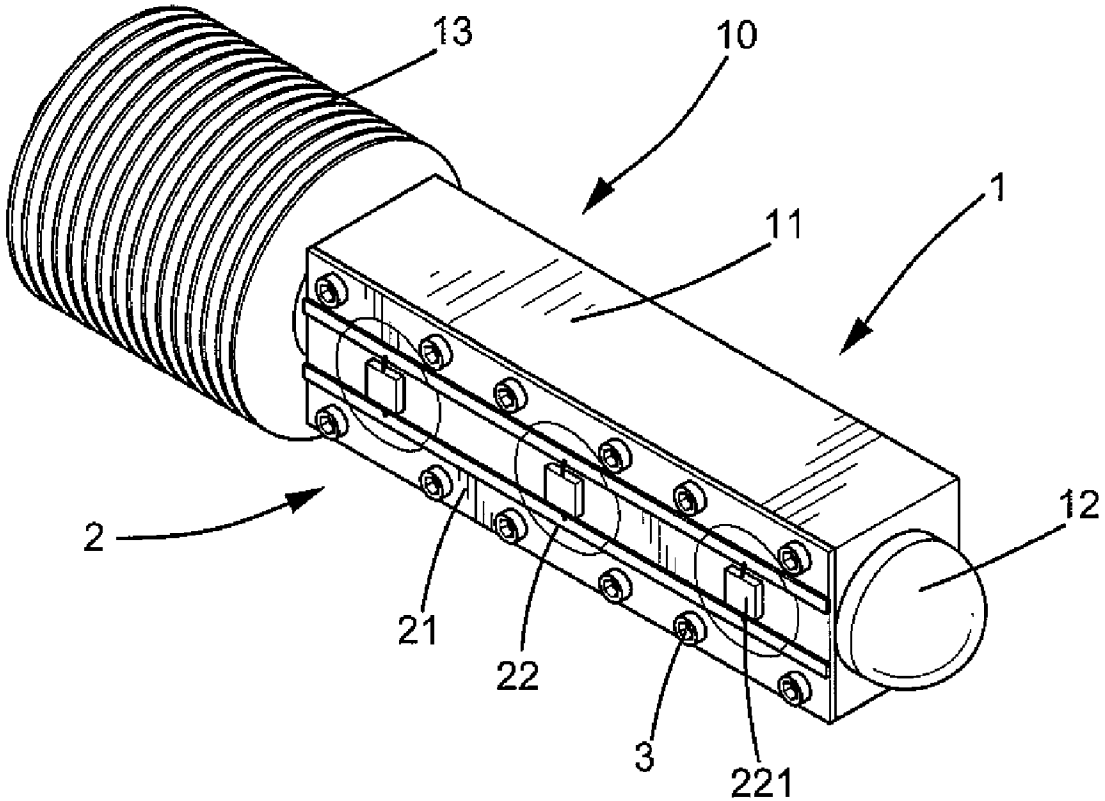
FIG. 9 shows a perspective view of a light-emitting diode module of a third embodiment according to the preferred teachings of the present invention.
Figure 10:
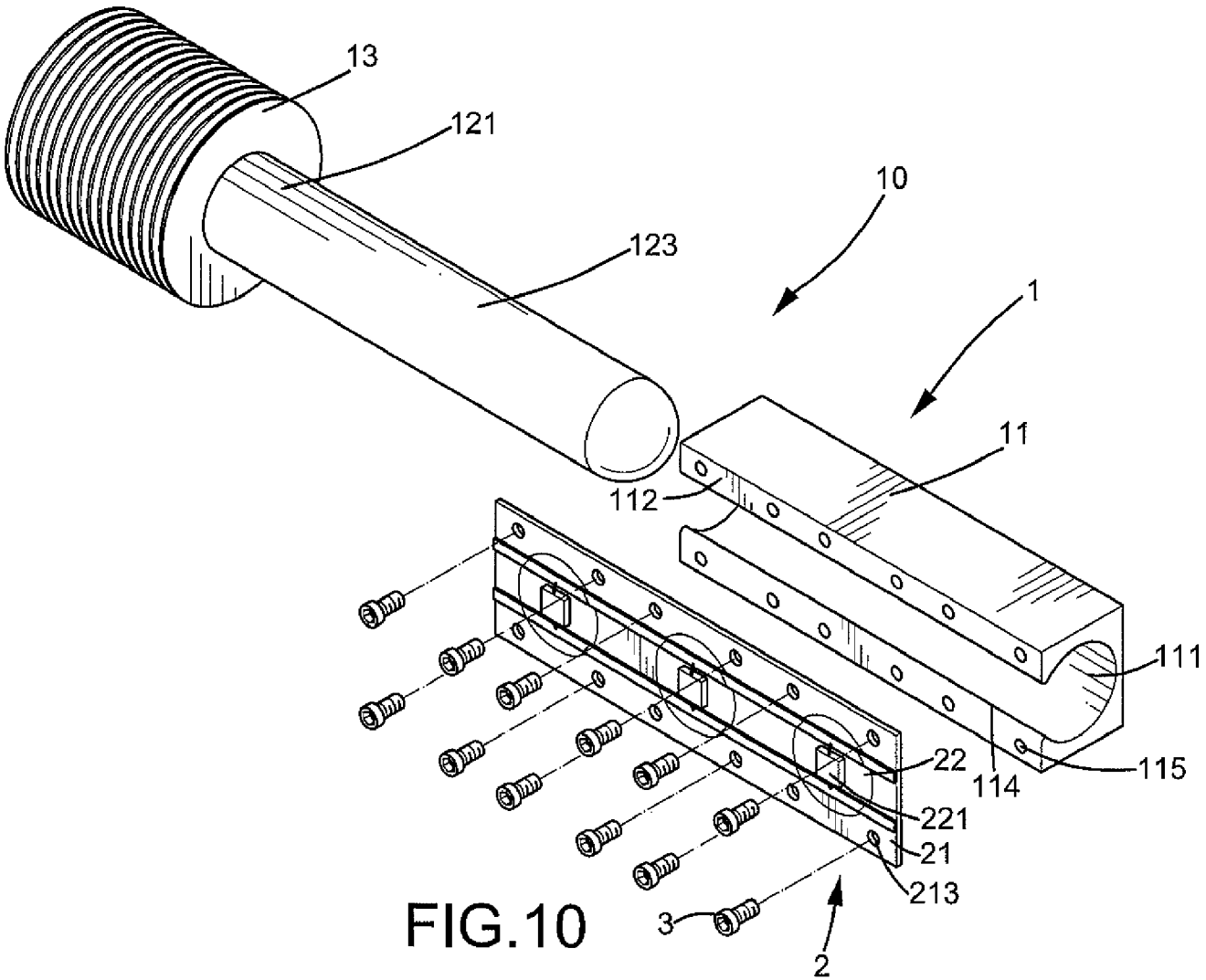
FIG. 10 shows an exploded perspective view of the light-emitting diode module of FIG. 9.

FIGS. 9 and 10 show a modification of heat conduction pipe 12 of light-emitting diode module 10 according to the present invention. In this modified embodiment, third portion 122 outside jacket 11 and finned heat sinks 13 mounted on third portion 122 are omitted. By such an arrangement, the length of heat conduction pipe 12 can be shortened and the volume of the light-emitting diode module 10 reduced.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A light-emitting diode module comprising:

a metal substrate having a first face and a second face opposite to the first face;

a plurality of light-emitting diode dies mounted to the first face of the metal substrate and in direct, thermal contact with the metal substrate;

a jacket including a coupling surface engaged with the second face of the metal substrate, with the jacket further including a longitudinal hole having a longitudinal axis, with the coupling surface of the jacket having an opening extending in a direction parallel to the longitudinal axis and in communication with the longitudinal hole;

a heat conduction pipe including a first portion received in the longitudinal hole of the jacket and a second portion outside the jacket, with the first portion of the heat conduction pipe having an outer periphery, with a portion of the outer periphery of the first portion of the heat conduction pipe being in direct, thermal contact with the second face of the metal substrate through the opening of the jacket to absorb heat generated by the plurality of light-emitting diode dies; and a finned heat sink mounted on the second portion of the heat conduction pipe and including a plurality of fins to dissipate heat transferred to the heat conduction pipe into an environment outside the finned heat sink.

2. The light-emitting diode module as claimed in claim 1, with the jacket being a thermally conductive metal block including the coupling surface and the longitudinal hole, with the longitudinal hole being circular in cross section, and with the opening extending in a plane tangent to the longitudinal hole.

3. The light-emitting diode module as claimed in claim 1, with the jacket being a thermally conductive metal tube including C-shaped cross sections and two parallel, spaced, longitudinal edges each extending in a direction parallel to the longitudinal axis, with the opening being defined between the two longitudinal edges, with two longitudinal bends projecting outwardly away from each other and from the two longitudinal edges and extending in a plane parallel to the opening, with each longitudinal bend including a surface facing the second face of the metal substrate, and with the surfaces of the two longitudinal bends forming the coupling surface.

4. The light-emitting diode module as claimed in claim 3, with each of the two longitudinal bends of the metal tube including a plurality of engaging holes, with the metal substrate including a plurality of through-holes, and with a plurality of fasteners being respectively extended through the plurality of through-holes of the metal substrate into the plurality of engaging holes of the metal tube.

5. The light-emitting diode module as claimed in claim 3, with the heat conduction pipe including annular cross sections and defining a chamber, with the chamber receiving heat transfer medium therein, and with the first portion of the heat conduction pipe being clamped in the longitudinal hole of the jacket.

6. The light-emitting diode module as claimed in claim 1, with the heat conduction pipe further including a third portion outside the jacket, with the first portion of the heat conduction pipe intermediate between the second portion and the third portion of the heat conduction pipe, and with the heat conduction pipe further including a second finned heat sink mounted on the third portion to dissipate heat transferred to the heat conduction pipe into the environment.

* * * * *